US007467737B1

(12) United States Patent
Bissett

(10) Patent No.: US 7,467,737 B1
(45) Date of Patent: Dec. 23, 2008

(54) GARMENT HANGER AND METHOD FOR USING SAME

(76) Inventor: Thomas Bissett, 115 Belglen Way, Los Gatos, CA (US) 95032

( * ) Notice: Subject to any disclaimer, the term of this patent is extended or adjusted under 35 U.S.C. 154(b) by 0 days.

(21) Appl. No.: 11/159,588

(22) Filed: Jun. 22, 2005

Related U.S. Application Data

(60) Provisional application No. 60/583,219, filed on Jun. 24, 2004.

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS

| | | | | |
|---|---|---|---|---|
| 599,244 | A | 2/1898 | Larsen | |
| 639,779 | A | 12/1899 | Sharf | |
| 1,195,041 | A | 8/1916 | Lendle | |
| 1,402,661 | A | 1/1922 | Stapp | |
| 2,114,803 | A | 4/1938 | Kurucz et al. | |
| 2,151,502 | A | 3/1939 | Donnellan | |
| 2,298,491 | A | 10/1942 | Lamar | |
| 2,425,547 | A | 8/1947 | Lipsitz | |
| 2,429,919 | A | 10/1947 | Boorstin | |
| 2,738,112 | A | 3/1956 | Miller | |
| 2,883,092 | A | 4/1959 | McMillan | |
| 3,207,392 | A | 9/1965 | Ericson | |
| 3,225,977 | A * | 12/1965 | Gandy | 223/85 |
| 3,301,445 | A | 1/1967 | Tobia | |
| 3,531,027 | A | 9/1970 | Malmin | |
| 3,815,797 | A | 6/1974 | Schamber | |
| 3,892,047 | A | 7/1975 | Müller-Scherak | |
| D242,756 | S | 12/1976 | Boren | |
| 4,085,519 | A | 4/1978 | Masika | |
| 4,592,497 | A | 6/1986 | Georges | |
| 4,673,114 | A | 6/1987 | Douglas | |
| 4,728,016 | A | 3/1988 | McPhee | |
| 4,949,739 | A | 8/1990 | Ryan | |
| 4,978,043 | A | 12/1990 | Uke | |
| 4,989,624 | A | 2/1991 | Darling | |
| 4,997,000 | A | 3/1991 | Feast et al. | |
| 5,037,487 | A | 8/1991 | Santos | |
| 5,056,693 | A | 10/1991 | DeBoe | |
| 5,094,020 | A | 3/1992 | Wingfield et al. | |
| 5,163,590 | A | 11/1992 | Lawler et al. | |
| 5,360,148 | A * | 11/1994 | Goscin et al. | 223/88 |
| 5,379,525 | A | 1/1995 | Raynor | |
| 5,394,621 | A | 3/1995 | Levy | |

(Continued)

*Primary Examiner*—Shaun R Hurley
(74) *Attorney, Agent, or Firm*—Dorsey & Whitney LLP

(57) ABSTRACT

A garment hanger for washing, drying and storing garments including a hanger body having a neck supporting portion and shoulder supporting portions extending outwardly from opposite sides of the neck supporting portion. The shoulder supporting portions have a width separating the opposite sides of the garment by an amount which will distend the same in an open condition at its lower end. A hook structure is coupled to the hanger body and formed for hanging of the hanger from a support device. The neck supporting portion extends upwardly from the shoulder supporting portions to hold the garment neck in an open condition. The neck opening or channel is substantially unobstructed and of a sufficient size for washing of the interior of the garment and to allow convection air flow through the neck portion while drying the garment. A process of convection flow drying of the garment also is disclosed.

20 Claims, 2 Drawing Sheets

U.S. PATENT DOCUMENTS

| | | | |
|---|---|---|---|
| 5,412,928 | A | 5/1995 | Reithel |
| 5,480,075 | A | 1/1996 | Robinson |
| D369,908 | S | 5/1996 | Pfutzenreuter |
| 5,555,648 | A | 9/1996 | Griffin |
| D376,480 | S | 12/1996 | Whitehead et al. |
| 5,950,882 | A | 9/1999 | Scott |
| 5,996,249 | A | 12/1999 | Manning |
| 6,328,186 | B1 | 12/2001 | Wing |
| 6,516,536 | B2 | 2/2003 | Ryden |
| 6,571,811 | B2 | 6/2003 | Kabboush |
| D484,321 | S | 12/2003 | Jacobs |

* cited by examiner

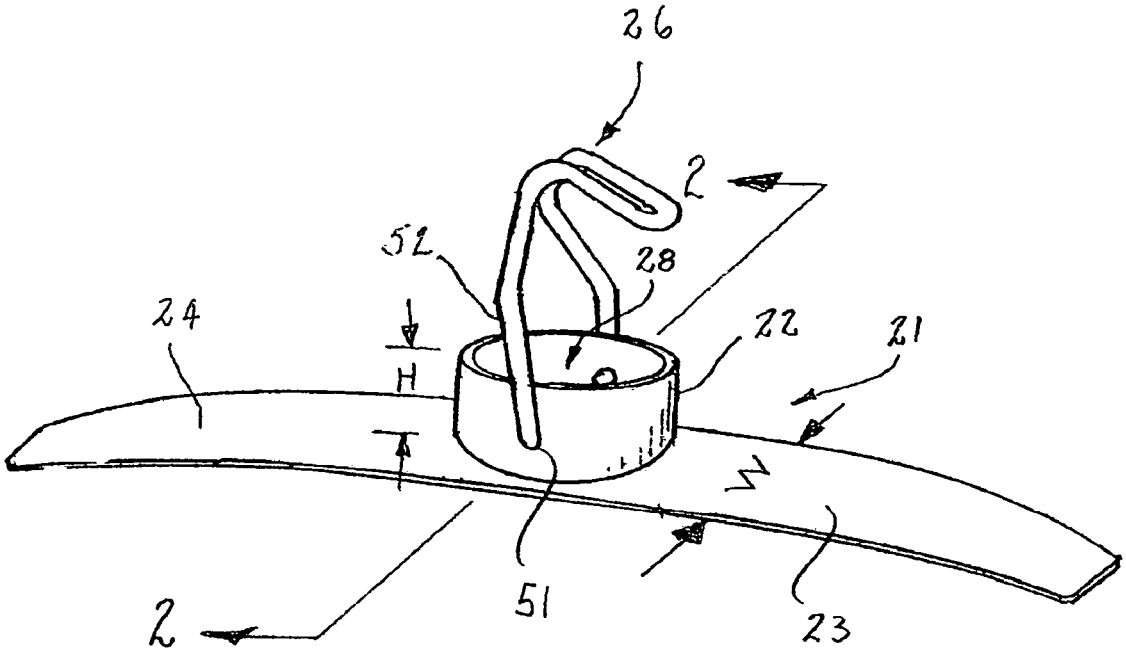
FIG.__1
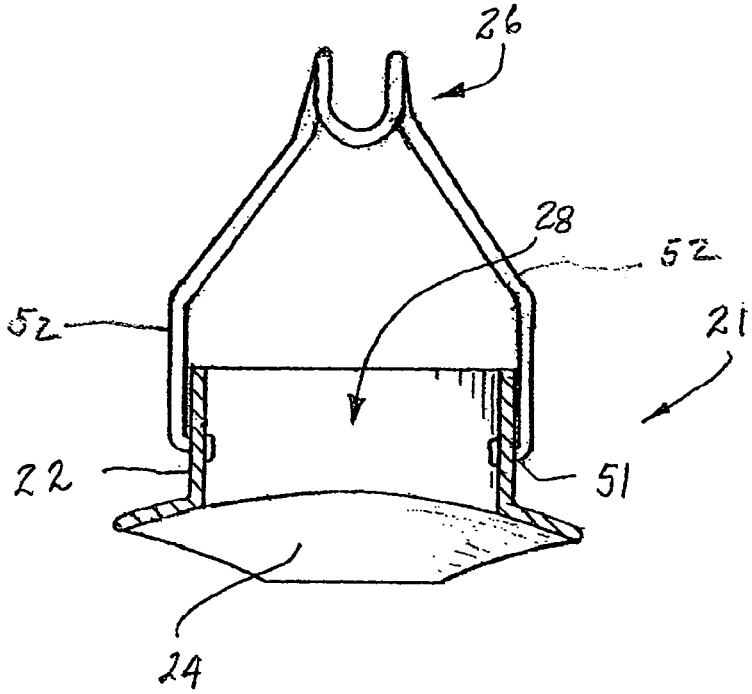
FIG.__2

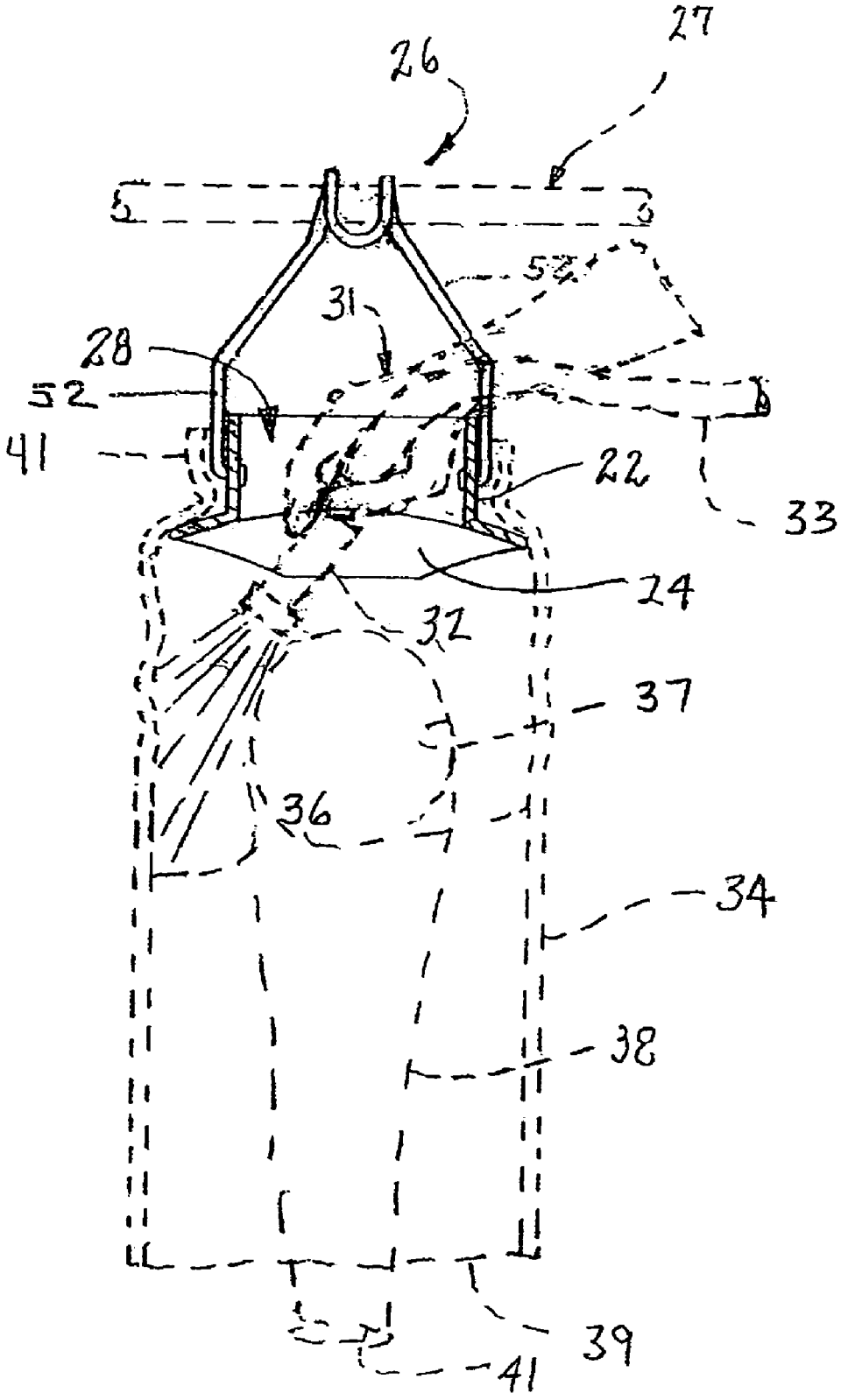
FIG.__3

GARMENT HANGER AND METHOD FOR USING SAME

CROSS-REFERENCE TO RELATED APPLICATIONS

This application claims priority U.S. Provisional Patent Application No. 60/583,219, filed Jun. 24, 2004, entitled GARMENT HANGER AND METHOD FOR WASHING AND DRYING GARMENTS, which application is incorporated in its entirety by this reference.

TECHNICAL FIELD

The present invention relates, in general, to garment hanging devices, and more particularly, to garment hangers which are adapted for use in washing, drying and storing of garments and particularly wetsuits and outdoor clothing.

BACKGROUND ART

Numerous garment hangers have been devised which have shoulder supporting arms that hold the front and back of the garment in a separated condition. This insures air circulation in the interior of the garment which reduces the likelihood of mold forming. For many types of garments no special attention needs to be given to the garment neck and collar in order for the garment hanger to be effective in drying the garment, and as a result, most prior art garment hangers give little attention to support of the neck and collar of the garment.

Various garment hangers and garment drying devices have also been devised in which hot air is forced down through a neck portion of the hanger into the interior of the hanger. Thus a positive pressure differential is created by a blower, and heated or unheated air is forced down through the interior of the garment as it is distended by the shoulder supporting portions or arms of the hanger. This is effective in drying garments, but it is also often is accomplished at the expense of great complexity and increased cost of the garment hanger. Thus, garment hangers which are augmented by power drying devices often are so expensive as to make their use as a mere storage device for the garment prohibitive.

In recent years one form of garment which is in widespread use has posed significant washing and drying, as well as storage, problems, namely, the wetsuit. Wetsuits typically are formed from neoprene foam material which can vary in thickness from 1 mm to 5 mm, or even more, and they usually include a collar or neck portion, which extends upwardly of the shoulders of the suit by a significant distance, as well as a downwardly depending shirt portion that covers the user's torso. Wetsuits often further cover the user's legs but usually stop short of the feet, which are covered by separate neoprene booties.

When a wetsuit is placed on most hangers, and particularly a neck-entry wetsuit, the neck or collar typically will drape or fold inwardly and at least partially close the neck opening because of the flexible nature of the foam. Wetsuits are often used in salt water, and even when not used in salt water, they resiliently conform tightly to the user's body, making washing and/or rinsing of the wetsuit interior, as well as exterior, after use highly desirable. The neoprene foam of a wetsuit also will tend to hold water which can cause the opposite sides of the wetsuit to drape together, preventing air circulation inside the wetsuit.

According, it is an object of the present invention to provide a garment hanger and method for drying a garment which are highly effective for unpowered, convection air circulation inside the garment to effect garment drying.

Another object of the present invention is to provide a garment hanger for washing, drying and storing garments, such as wetsuits, life jackets and outdoor clothing, which has a minimum number of components and is easy and inexpensive to manufacture.

Still a further object of the present invention is to provide a garment hanger and method which facilitate washing (rinsing) of the interior of a garment before drying.

Still a further object of the present invention is to provide a garment hanger which is easy to use, is durable and corrosion resistant, is suitable for hanging a wide range of garments.

The garment hanger and process of the present invention have other objects and features of advantage which will apparent from, and set forth in more detail in, the accompanying drawings and following description of the Best Mode of Carrying Out the Invention.

DISCLOSURE OF THE INVENTION

The garment hanger for washing, drying and storing garments of the present invention is comprised, briefly, of a hanger body having a neck supporting portion and shoulder supporting portions extending outwardly from opposite sides of the neck supporting portion. The shoulder supporting portions have a width dimension separating opposite sides of the garment which is hung on the hanger body. So as to maintain the lower end of the garment in an open condition, a hook structure is coupled to the hanger body and formed for hanging on the hanger from a support device, such as a closet hanger rod or wall-mounted bracket. The neck supporting portion of the garment hanger extends upwardly from the shoulder supporting portion to hold the garment neck in an open condition and the neck supporting portion defines a neck opening or channel through the garment hanger which is substantially unimpeded or unobstructed and of a size sufficient for insertion of a hand of a user through the opening and into an interior of the garment while holding a washing/rinsing nozzle. Additionally, the neck opening is sufficient large and the shoulder supporting portions sufficiently wide to hold the garment open for convection air flow in a "chimney-effect" upwardly out of the neck opening while the garment is drying on the hanger. The hook structure of the garment hanger is attached to the hanger body and formed for access to the neck opening for insertion of the wash/rinse nozzle and the user's hand while the garment is being hung from a support device. Most preferably, the garment hanger body is monolithically formed from a thermoplastic material and the hook is a yoke-type hook permitting access to the neck opening.

In another aspect of the present invention, a process for drying a garment is provided which is comprised, briefly, of the steps of hanging the garment on the garment hanger which distends opposite sides of the garment from each other by an amount for air sufficient circulation and which holds the neck or collar portion of the garment in an open condition; and drying the garment by allowing a convection air flow up through the garment interior and out a neck opening of the garment hanger. The process further preferably includes a step of, prior to the drying step, washing or rinsing the interior of the garment by inserting a washing or rinsing nozzle through the neck opening of the garment hanger while the garment is hung on the hanger.

BRIEF DESCRIPTION OF THE DRAWINGS

FIG. 1 is a top pictorial view of a garment hanger constructed in accordance with the present invention.

FIG. 2 is an enlarged, end elevation view, in cross section, taken substantially along the plane of line 2-2 of FIG. 1.

FIG. 3 is an end elevation view in cross section corresponding to FIG. 2 with a garment shown supported on the garment hanger in broken lines.

BEST MODE OF CARRYING OUT THE INVENTION

Reference will now be made in detail to the preferred embodiment of the present invention, an example which is illustrated in the accompanying drawings. While the invention will be described in conjunction with the preferred embodiment, it will be understood that it is not intended to limited the invention to that embodiment. On the contrary, the invention is intended to cover alternatives, modifications and equivalents.

The garment hanger of the present invention is suitable for washing, drying and storing garments and it includes a hanger body, generally designated 21, having a neck supporting portion 22 and shoulder supporting portions 23 and 24 extending outwardly from opposite sides of neck 22. Coupled to hanger body 21 is a hook structure, generally designed 26, which is formed for hanging of hanger body 21 from a support device, such as a closet rod 27 (FIG. 3) or wall-mounted hook or bracket or a clothes line. Neck supporting portion 22 preferable is provided by an annular collar which extends upwardly above shoulders 23 and 24 and defines a neck opening or channel 28 which extends through hanger body 21, as best may be seen in FIG. 2. While a continuous annular flange is shown in the drawing, neck supporting portion 22 can take polygonal shape and be discontinuous, for example, neck 22 can be provided by a plurality of fingers which are positioned around the periphery of opening 28 and extend upwardly by a distance preventing the neck or collar of the garment from folding across and closing opening 28.

Neck opening or channel 28 through hanger body 21, is sufficiently larger in size to enable insertion of a hand of a user through the channel while holding a washing or rinsing nozzle. Thus, as seen in FIG. 3, a user's hand 31, holding a nozzle 32, to which a hose 33 is attached, can be inserted through opening or channel 28 so as to permit the hanger to support a garment 34 while the interior surface 36 of the garment is being washed or rinsed using the nozzle 32. Typically collar opening 28 will have a diameter, or transverse dimension if not annular, of at least about 3 inches and preferable about 4 to about 6 inches.

As will be apparent from FIG. 3, channel 28 through hanger body 21 must be substantially unimpeded or unobstructed so as to permit nozzle 32 and user's hand 31 to be extended through the channel to the interior of garment 34. Once the user has the nozzle inside the garment, it can be swung around to wash or rinse the body of the garment. Moreover, nozzle 32 can even be inserted partially down arm hole opening 37 so as to permit washing or rinsing of the interior surface of garment arm 38.

In FIG. 3 garment 34 is shown as a garment which would cover the torso of a wearer, such as a shirt, sweater, sweatshirt, fire jacket, or wetsuit top. It will be understood, however, that full body wetsuits also will benefit from user of the present garment hanger, and to that end, opening 28 can be large enough that the user can insert his or her arm into the channel. The garment illustrated has a bottom 39 which also is open and which will permit washing or rinsing of interior surface 36 of garment 34 from opening 39. Arm openings 41 also can be used for access to the interior surface of the garment. For full body wetsuits, the leg openings at the bottom of the suit can be used, and rinsing or washing of interior surface 36 can also be accomplished by inserting washing nozzle 32 through front or back zippered or buttoned openings in the garment, if they are present.

As also will be seen from FIGS. 1 and 3, shoulder portions 23 and 24 should have a sufficient width dimension so as to separate opposite sides of the garment, for example, the front and the back, by a distance which holds bottom opening 39 of the garment open, even when the garment is wetted or soaked by the washing and/or rinsing process. There will a tendency for the lower end of the wet garment to drape inwardly, but if the shoulder supporting portions 23 and 24 are sufficiently wide in the transverse dimension, as shown by W in FIG. 1, the garment end 39 will be maintained in an open condition. For garments such as wetsuits, it has been found that the width dimension of shoulder supporting portions 23 and 24 should be at least 2 inches, and preferably W is in the range of about 4 to about 6 inches. Shoulder supporting portions 23 and 24 can taper inwardly somewhat, as seen in FIGS. 1 and 3, toward the outer ends of the shoulder supporting portions.

It is typical for wetsuits to include a collar or neck portion 41 (FIG. 3) and often the wetsuit will zip open along the front or back. Some wetsuits, however, are neck-entry suits with collars 41 that are formed of a very elastic neoprene foam. The neck-entry wetsuits tend to have highly resilient and flexible collars which permit distortion for the user to enter the wetsuit through the opening defined by the collar. In any event, both standard and neck-entry collars for wetsuits typically will collapse and tend to close opening to the suit at the collar unless neck supporting portion 22 has sufficient height so as to prevent such collapsing or draping of the collar across the garment neck opening. In the most preferred form, neck supporting portion 22 of the present garment hanger will have a height dimension, H, of at least about 1 inch. Most preferably collar height H is between about 2 and about 4 inches. This will insure that the neck structure of most wetsuits will not collapse across opening or channel 28 in the garment hanger to interfere with either washing or drying of the wetsuit.

As described in connection with FIG. 3, the user must be able to insert hand 31 into channel 28 without being impeded, which means that hanger hook structure 26 cannot block channel 28. Thus, hook 26 should be attached to garment hanger body 21 and should be formed in a manner providing access to neck opening or channel 28 when the garment is being hung from a support device, such as closet rod 27. To this end hook 26 can be seen from the Figures to be advantageously coupled to the exterior to neck portion 22 and to extend upwardly in a yoke which will permit the user ready access to channel 28. Note that, as shown in FIG. 3, the upward and outward extension of yoke legs 52 also contributes to holding collar portion 41 of a garment upright and open. One will appreciate that even if garment collar 41 were to extend above the upper extent of neck supporting portion 22, yoke legs 52 would contribute to holding the upper extent of the collar open. The user can insert his or her hand over one of the shoulder supporting portions or arms 23 or 24 between spaced apart the yoke legs 52 of hook 26 and into the neck opening 28. The height of a yoke-type hook 26 above the top edge of collar supporting portion 22 is preferably in the range of about 6 inches to about 12 inches. The yoke should be pivotally coupled to neck 22 proximate the transverse center of the hanger body so as to balance the hanger weight without tilting the shoulder portions, while still allowing easy insertion of the user's hand and a wash nozzle.

An important further aspect of the garment hanger of the present invention is that neck opening or channel 28 is also sufficiently large to enable convection air flow upwardly out of neck channel 28 during drying of the garment. When a garment such as a shirt or wetsuit top is being dried, it will be seen from FIG. 3 that the garment will be held by the shoulder supporting portion in a generally tubular configuration with neck supporting portion 22 holding neck 41 open and the shoulders holding bottom end 39 of the garment open. When the garment is hung outside, for example, in a sunny location, the warm air around the garment and/or the sun will tend to warm the garment and the garment warmth, in turn, will tend to heat air inside the garment. The warming air will rise inside the garment, creating a convection current inside the garment. The open bottom end of the garment, due to the shoulder supporting arms, and the relatively unimpeded or unobstructed neck opening 28 permit air to enter at the bottom and escape at the neck opening. Air flow, therefore, is induced in a general upward direction inside the garment through neck opening 28 in a "chimney-effect," which enhance the rate at which the garment dries.

The partial pressure differential which induces air flow in the chimney-effect is very small but it enables garment 34 to be dried at a more rapid rate without having to use a powered blower. Since prior art garment hangers either have solid necks or are constructed in a manner which will allow the garment neck 41 to collapse, across the neck opening, prior hangers have not employed this convection or chimney-effect drying of garments. Accordingly, a further aspect of the present invention is to provide a process for garment drying which is comprised of supporting the garment on a hanger with a neck distending structure and shoulder support structure which holds the lower end of the garment open, and the step of drying the garment using convection air flow up through the garment and garment hanger by employing a chimney-effect circulation to enhance the rate of drying.

The garment hanger body is preferably monolithically formed, for example, from a thermoplastic material such as ABS or polypropylene. An injection molded or blow molded process can be employed, and hook 26 can be formed of plastic rod material which is pivotally attached to the hanger body, preferably at openings 51 in neck 22. Such an all-plastic construction eliminates metal parts which can corrode, particularly when exposed to salt water, as often is the case when wetsuits are involved. It will be appreciated, however, that the garment hanger of the present invention also can be used for many other types of garments, including shirts, sweaters, jackets, life jackets, etc. Pivotal mounting of hook 26 to neck 22 also enables folding or pivoting of the hook down into a position proximate one of the shoulder supporting arms 23 and 24 for easy insertion into and removal from the garment. Pivotal mounting of hooks 26 also aids in compact shipment of the garment hangers and ease of package.

The garment hanger of the present invention can also be used to store garments in environments which may be conducive to mold or mildew and their accompanying odors. Hanger 21 holds the garment open and allows air circulation with the front and back fabric of the garment being separated by a significant air gap. Garments stored on this device on boats or buildings in which environments are not controlled are not likely to be affected by moisture, and garments can even be stored outside, such as foul weather or rain gear, fishing vests and life vests.

The garment hanger of the present invention is light in weight and yet capable of supporting relatively heavy wet garments. It is formed of non-corrosive materials suitable for mass production at low cost and it includes a folding or pivotal hook structure for ease of mounting into the garment and compact shipping and packaging.

The foregoing description of a specific embodiment of the present invention has been presented for the purpose of illustration and description. It is not intended to be exhaustive or to limit the invention to the precise form disclosed. Obviously many modifications and variations are possible in light of the above teaching, and the embodiment was chosen and described in order to best explain the principals of the invention and its practical application in order to enable others skilled in the art to best utilize the invention and its various embodiments.

What is claimed is:

1. A garment hanger for use with a garment having an interior comprising:

a hanger body having a neck supporting portion and shoulder supporting portions formed integral with the neck supporting portion and extending outwardly from opposite sides of the neck supporting portion, the shoulder supporting portions adapted for supporting the garment and each having a width dimension sufficient to hold opposite sides of the garment in a separated condition; and the neck supporting portion extending upwardly from the shoulder supporting portions and being formed to hold a neck of the garment in a distended open condition, the neck supporting portion being provided with a single neck opening extending vertically through the hanger body and being substantially free of obstructions for facilitating the flow of air up through and out of the garment so as to enhance drying of the interior of the garment.

2. The garment hanger as defined in claim 1 wherein, the neck opening has a transverse dimension of at least about 3 inches.

3. The garment hanger as defined in claim 1, and a hook structure attached to the garment hanger body and permitting access to the neck opening for insertion of a wash nozzle through the opening while the garment is hung from a support device.

4. The garment hanger as defined in claim 3 wherein, the hook structure is attached to the neck supporting portion.

5. The garment hanger as defined in claim 4 wherein, the hook structure is pivotally coupled to the neck supporting portion for pivoting between a position closely proximate one of the shoulder supporting portions and a position extending above the neck supporting portion.

6. The garment hanger as defined in claim 3 wherein, the hook structure is a yoke-like hook having a spaced apart pair of legs pivotally coupled to the hanger body.

7. The garment hanger as defined in claim 1 wherein, the neck supporting portion is a collar extending upwardly of the shoulder supporting portions by a distance sufficient to prevent the neck of the garment from draping across the neck opening of the garment hanger.

8. The garment hanger as defined in claim 1 wherein, the hanger body is monolithically formed from a thermoplastic material.

9. A process for drying a garment comprising the steps of:

supporting the garment on a garment hanger having a neck supporting structure being provided with a single substantially unobstructed neck opening extending vertically therethrough and having garment supporting shoulders formed integral with the neck supporting structure and of sufficient width to hold front and back sides of a wet garment hung on the garment hanger in an open position at a bottom of the garment; and drying the garment by convection air flow up through the open bottom of the garment and up an interior of the garment and out through the neck opening of the garment hanger.

10. The process as defined in claim 9 and the step of:

after the supporting step and prior to the drying step, the step of washing the interior of the garment using a wash nozzle inserted through the neck opening and manually manipulated while inside the garment.

11. A garment hanger comprising:

a hanger body having a neck supporting portion, and having shoulder supporting portions extending outwardly from opposite sides of the neck supporting portion, the shoulder supporting portions each having a width dimension holding opposite sides of a garment hung on the hanger in a separated condition; the neck supporting portion extending upwardly from the shoulder supporting portions and being formed to hold a neck of the garment in a distended open condition, the neck supporting portion further defining a single neck opening extending through the hanger body and being substantially free of obstructions for facilitating the flow of air up through and out of the garment so as to enhance drying of the interior of the garment; and a hook structure attached to the neck supporting structure of the hanger body and formed to permit access to the neck opening for insertion of a wash nozzle through the opening while the garment is hung from a support device; wherein the hook structure is pivotally coupled to the neck supporting structure for pivoting between a position closely proximate one of the shoulder supporting structures and a position extending above the neck supporting structure.

12. The garment hanger as defined in claim 11 wherein the neck opening has a transverse dimension of at least about 3 inches.

13. The garment hanger as defined in claim 11 wherein the hanger body is formed from plastic.

14. A garment hanger comprising:

a hanger body having a neck supporting portion, and having shoulder supporting portions extending outwardly from opposite sides of the neck supporting portion, the shoulder supporting portions each having a width dimension holding opposite sides of a garment hung on the hanger in a separated condition; the neck supporting portion extending upwardly from the shoulder supporting portions and being formed to hold a neck of the garment in a distended open condition, the neck supporting portion further defining a single neck opening extending through the hanger body and being substantially free of obstructions for facilitating the flow of air up through and out of the garment so as to enhance drying of the interior of the garment; and a hook structure attached to the hanger body and formed for access to the neck opening for insertion of the wash nozzle through the opening while the garment is hung from a support device; wherein the hook structure is a yoke-like hook having a spaced apart pair of legs pivotally coupled to the hanger body.

15. The garment hanger as defined in claim 14 wherein the neck opening has a transverse dimension of at least about 3 inches.

16. The garment hanger as defined in claim 14 wherein the hanger body is formed from plastic.

17. A garment hanger for use with a garment having an interior comprising:

a unitary hanger body having a neck supporting portion and shoulder supporting portions extending outwardly from opposite sides of the neck supporting portion, the shoulder supporting portions adapted for supporting the garment and each having a width dimension sufficient to hold opposite sides of the garment in a separated condition; and the neck supporting portion extending upwardly from the shoulder supporting portions and being provided with a single neck opening extending vertically through the hanger body that has a transverse dimension of at least about 3 inches and is substantially free of obstructions for facilitating the flow of air up through and out of the garment so as to enhance the drying of the interior of the garment.

18. The garment hanger as defined in claim 17 wherein the unitary hanger body is formed from plastic.

19. The garment hanger as defined in claim 17 wherein each of the shoulder supporting portions has a maximum width of at least 2 inches.

20. The garment hanger as defined in claim 17, and a hook structure coupled to the neck supporting portion and extendable over the neck opening.

* * * * *